US009512604B1

(12) United States Patent
Hunter

(10) Patent No.: US 9,512,604 B1
(45) Date of Patent: Dec. 6, 2016

(54) SYSTEM AND METHOD OF USE FOR REMOVING WASTE ODOR PROXIMATE A TOILET

(71) Applicant: Richard Allen Hunter, Las Vegas, NV (US)

(72) Inventor: Richard Allen Hunter, Las Vegas, NV (US)

( * ) Notice: Subject to any disclaimer, the term of this patent is extended or adjusted under 35 U.S.C. 154(b) by 0 days.

(21) Appl. No.: 14/454,649

(22) Filed: Aug. 7, 2014

(51) Int. Cl.
*E03D 9/05* (2006.01)
*E03D 9/052* (2006.01)

(52) U.S. Cl.
CPC ..... *E03D 9/052* (2013.01)

(58) Field of Classification Search
USPC ..... 4/209 R, 213
See application file for complete search history.

(56) References Cited

U.S. PATENT DOCUMENTS

| | | | | |
|---|---|---|---|---|
| 5,718,005 | A * | 2/1998 | Ng | E03D 9/05 4/213 |
| 5,940,893 | A * | 8/1999 | Shum | 4/213 |
| 8,695,123 | B2 * | 4/2014 | Lanza | 4/213 |
| 2008/0010731 | A1 * | 1/2008 | Martin | C02F 1/78 4/213 |
| 2013/0263366 | A1 * | 10/2013 | Prete et al. | 4/213 |
| 2014/0007332 | A1 * | 1/2014 | Hayes et al. | 4/209 R |

* cited by examiner

*Primary Examiner* — Lauren Crane
(74) *Attorney, Agent, or Firm* — Greenberg Traurig LLP

(57) ABSTRACT

A toilet odor removal system and method of use uses an air intake member connected to an air exit member with a fan member attached to the air exit member. When installed, the air intake member is inside the toilet tank and the air exit member is outside of the toilet tank so that the air in the toilet tank and toilet bowl may be evacuated therefrom by activating the fan member to draw the air from both the toilet tank and toilet bowl via the passageway from the toilet tank to the toilet bowl or water overflow tube in communication with a toilet tank. A toilet tank water supply line runs through the air intake member and air exit member.

12 Claims, 7 Drawing Sheets

SYSTEM AND METHOD OF USE FOR REMOVING WASTE ODOR PROXIMATE A TOILET

FIELD OF THE INVENTION

The embodiments of the present invention relate to an automated system for removing odors proximate to a toilet.

BACKGROUND

Waste odor near toilets is an age-old nuisance. Various systems and methods have been devised to address the waste-odor-near-a-toilet problem. Unfortunately, such systems and methods suffer drawbacks including: (i) complexity; (ii) unreliability and (iii) expense.

It would be advantageous to develop a waste odor removal system and method for use with a toilet which is easy to install, reliable and inexpensive relative to other systems.

SUMMARY

Accordingly, one embodiment of the present invention comprises an air intake member attached to an air exit member with a fan member attached directly or via an intermediate tube, pipe or similar passageway to the air exit member. When installed, the air intake member resides inside the toilet tank and the air exit member resides outside of the toilet tank so that the air in the toilet tank and toilet bowl may be evacuated therefrom by activating the fan member drawings the air from both the toilet tank and toilet bowl via the opening (i.e., flush valve) from the toilet tank to the toilet bowl. A toilet tank water supply tube runs through the air intake member and air exit member.

In one embodiment, the air intake member and air exit member are T-shaped members connected in line with the stem portions perpendicular to the connected passageways through which the water supply tube extends. In practice, the fan member, when activated during the flush cycle, draws or sucks air from the toilet tank and toilet bowl, via the flush valve leading from the toilet tank to the toilet bowl, through the air intake member then air exit member into an exit tube extending to a location remote from the toilet.

Other variations, embodiments and features of the present invention will become evident from the following detailed description, drawings and claims.

DETAILED DESCRIPTION

Figure 1:
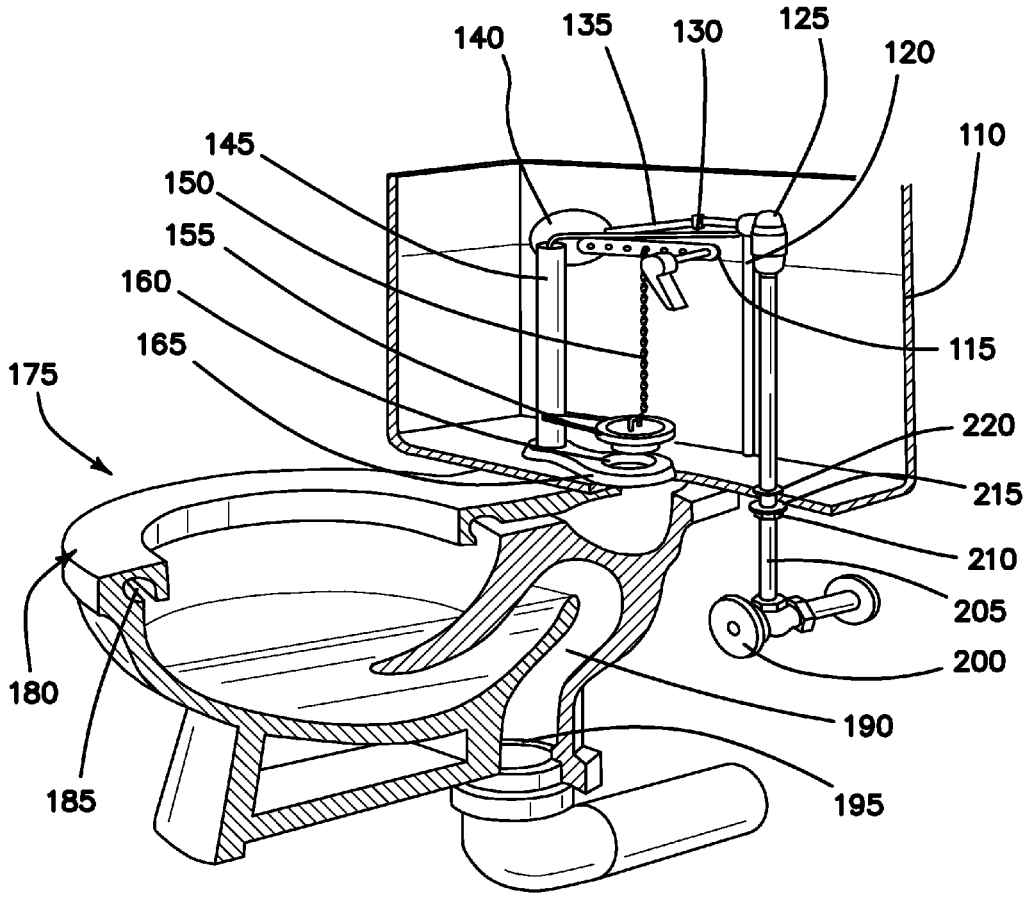
FIG. 1 illustrates a cross-sectional/internal side view of a conventional toilet.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the embodiments of the present invention may be fabricated of any suitable materials, including, but not limited to, plastics (e.g., PVC), alloys, composites, resins and metals or combinations thereof, and may be fabricated using suitable techniques, including, but not limited to, molding, casting, machining and rapid prototyping or combinations thereof.

FIG. 1 shows a cross-sectional/internal side view of a conventional toilet 100. A toilet tank 110 includes a lever 115, tank fill tube 120, inlet valve 125, bowl refill tube 130, float arm 135, float ball 140, overflow pipe 145, lift wire 150, flapper 155, flush valve seat 160 and flush valve 165. A toilet bowl 175 includes rim 180, flush passage 185, trap 190 and seal 195. A shut off valve 200 and supply tube 205 control water to the toilet tank 110. The supply tube 205 enters into the tank 110 through a tank opening via a mounting nut 210, locknut 215 and gasket 215. Operation of a conventional toilet comprises (i) pushing on the handle which pulls the chain lifting the flapper releasing the flush valve causing about 2 gallons of water to rush from the toilet tank to the toilet bowl in about 3 seconds via the flush valve; (ii) after the water leaves the toilet tank, the flapper reseats closing the flush valve; (iii) the rush of water activates the siphon in the toilet bowl sucking all contents down the drain; (iv) meanwhile as the level of the water in the toilet tank is falling so does the float; (v) the falling float turns on the refill valve refilling the toilet tank and toilet bowl with water; and (vi) once the float rises to a threshold level, the refill valve shuts off. The overflow tube prevents accidental flooding.

Figure 2:
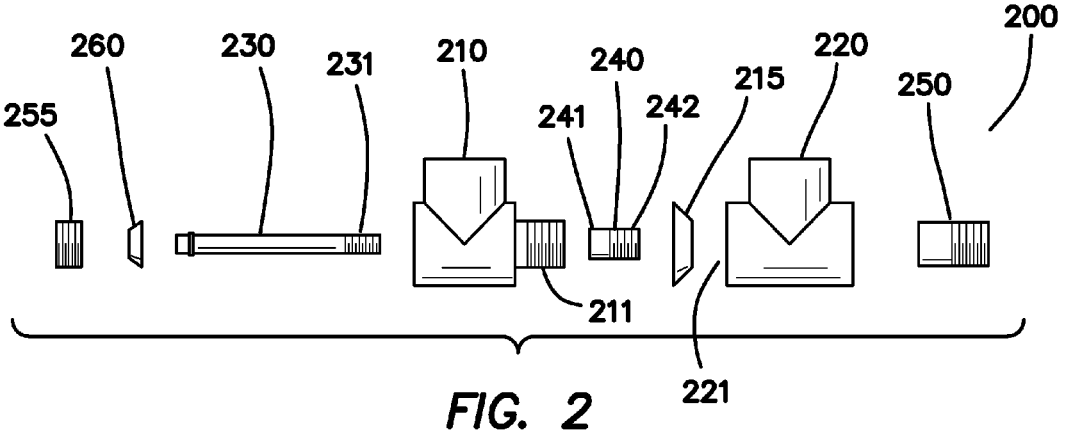
FIG. 2 illustrates an exploded side view of an air intake member and air exit member unit according to the embodiments of the present invention.
Figure 3:
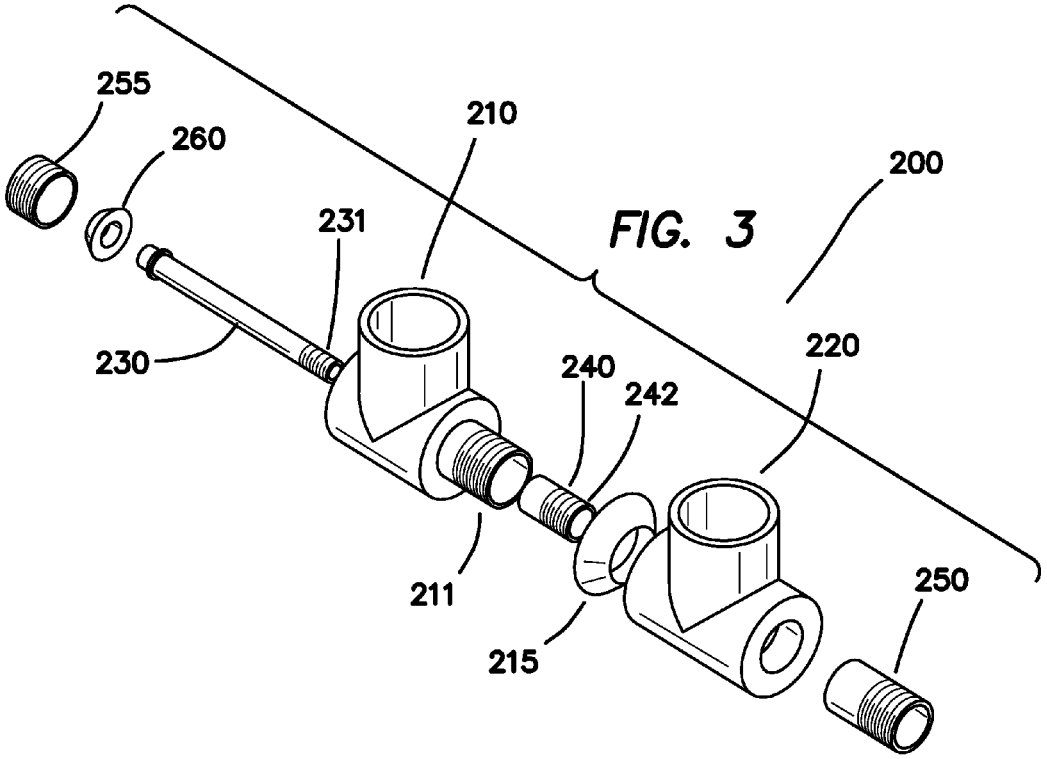
FIG. 3 illustrates an exploded upper view of the air intake member and air exit member unit according to the embodiments of the present invention.
Figure 7:
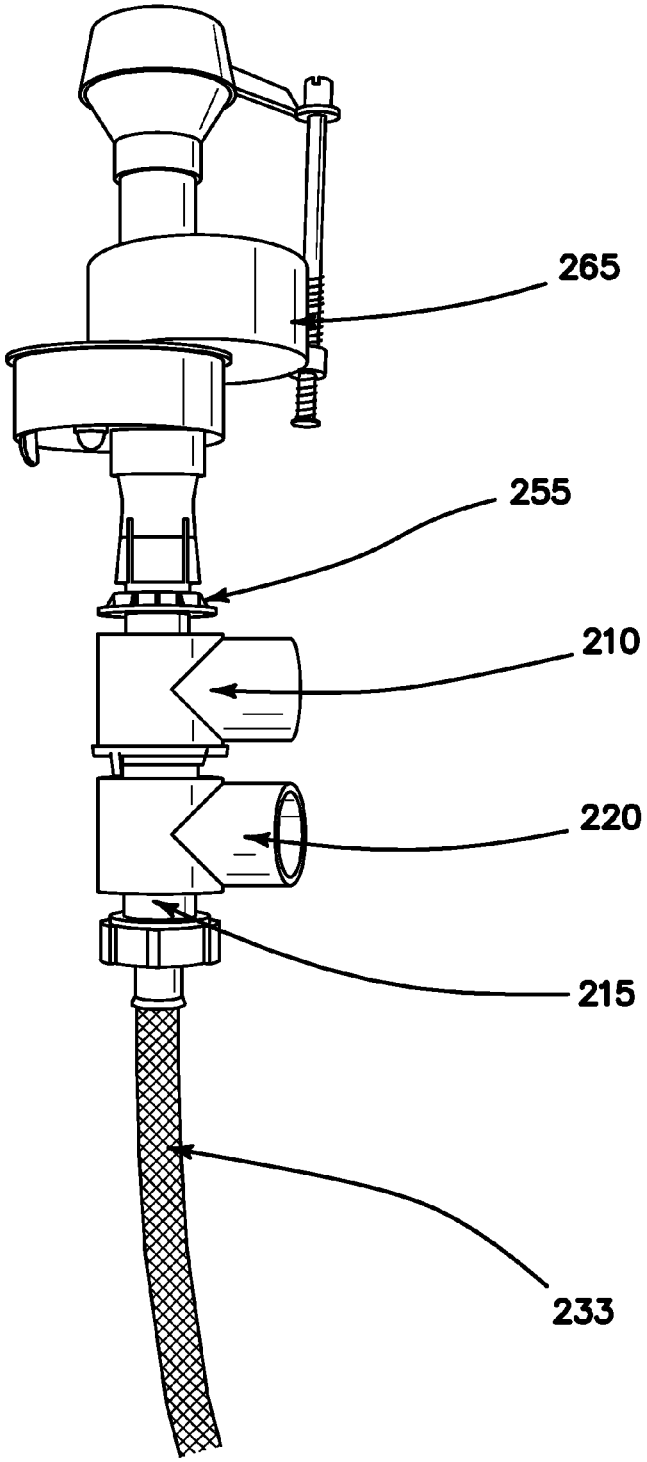
FIG. 7 illustrates a front view the air intake member and air exit member unit connected to a float mechanism according to the embodiments of the present invention.

FIGS. 2 and 3 illustrate exploded side and upper views, respectively, of a partially hollow air intake member and a partially hollow air exit member unit 200. The air intake member and a partially hollow air exit member unit 200 comprises an air intake member 210 and air exit member 220 attached to one another via a threaded arrangement comprising a threaded male extension 211 on the air intake member 210 and a threaded opening 221 in the air exit member 220. A grommet 215 provides a seal between the attached air intake member 210 and air exit member 220. A water supply tube 230 is configured to insert through the air intake member 210 and into the air exit member 220. Within the air exit member 220, an intermediary connector 240 attaches at a first end 241 to a threaded end 231 of the water supply tube 230 and at a second threaded end 242 attaches to a threaded opening in an extension coupler 250 configured to receive a water supply. A second end 232 of the water supply tube 230 attaches to a float mechanism coupling 255 and grommet 260 arrangement. As shown in FIG. 7, the float mechanism coupling 255 is configured to receive a conventional-type float mechanism. A conventional-type float mechanism may include a float arm, float ball or similar article which floats and connection means for connecting it to the tank and/or bowl/tank refill tube.

Figure 4:
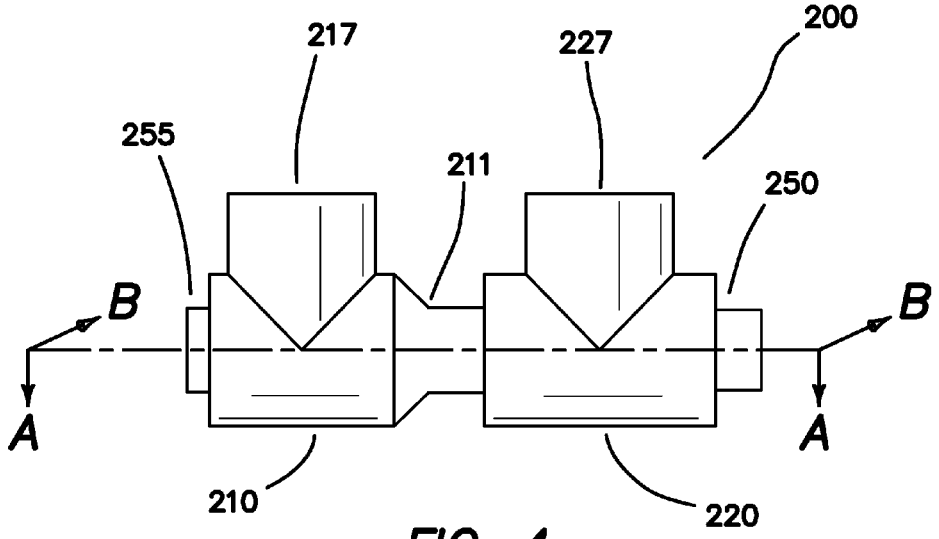
FIG. 4 illustrates a side view of the assembled air intake member and air exit member unit according to the embodiments of the present invention.
Figure 5:
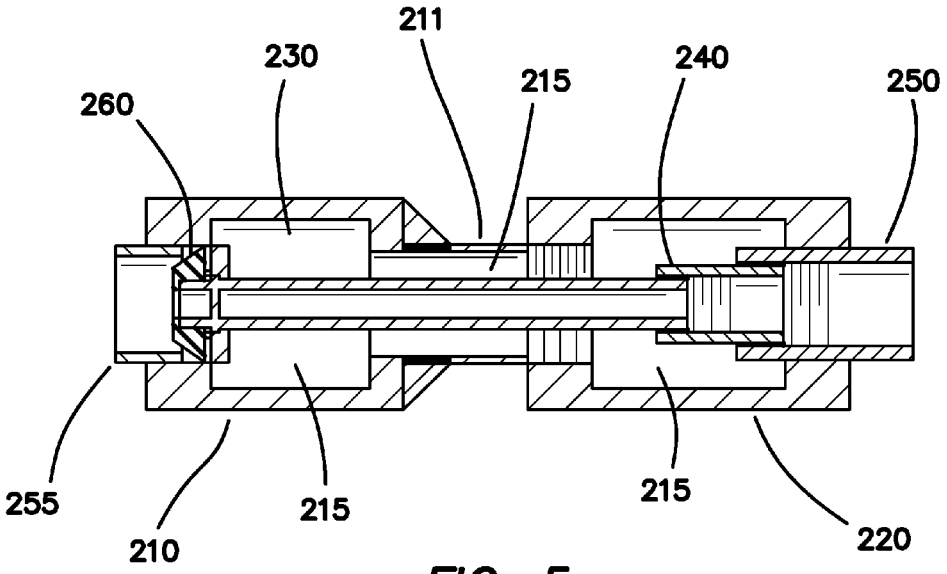
FIG. 5 illustrates a first cross-sectional view of the assembled air intake member and air exit member unit according to the embodiments of the present invention.
Figure 6:
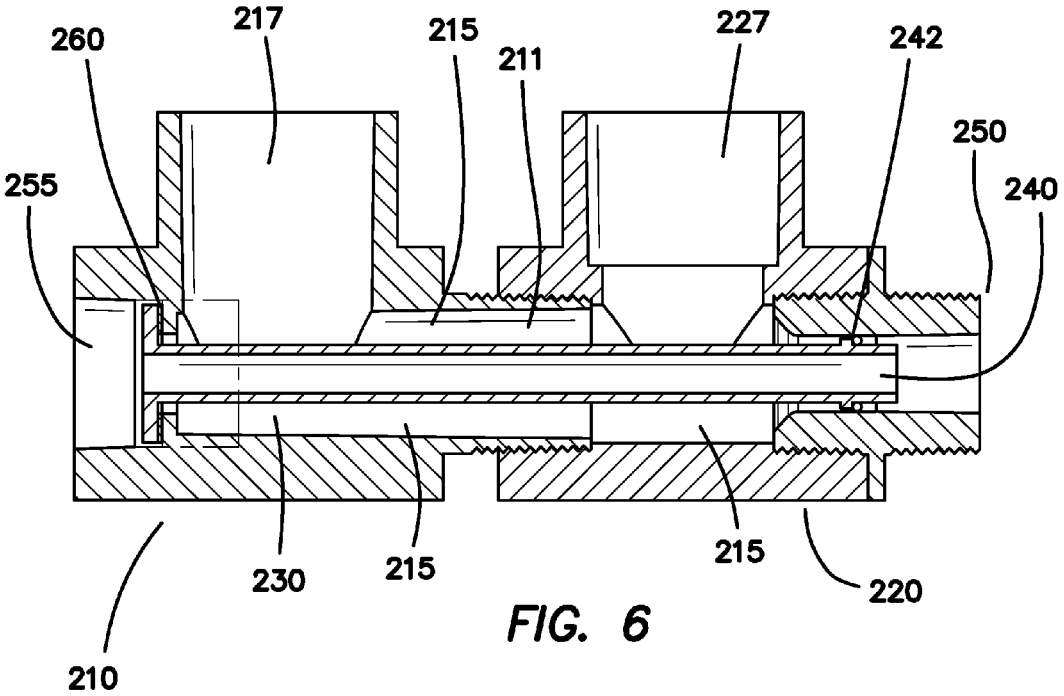
FIG. 6 illustrates a second cross-sectional view of the assembled air intake member and air exit member unit according to the embodiments of the present invention.
Figure 8:
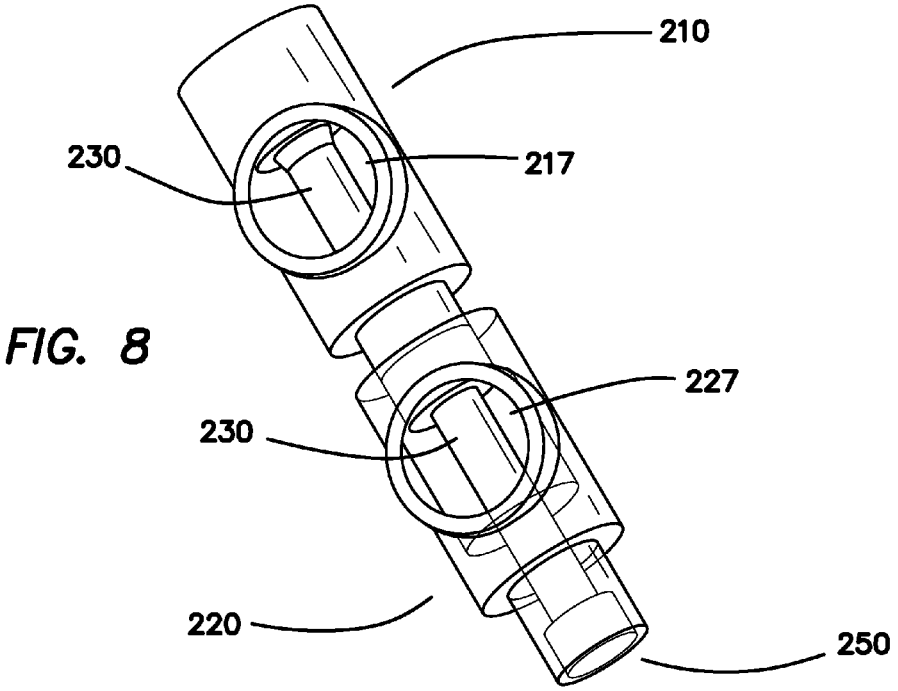
FIG. 8 illustrates an internal view of the air intake member and air exit member according to the embodiments of the present invention.

FIG. 4 shows a side view of the assembled air intake member and air exit member unit 200. Air intake member 210 includes a hollow air intake passageway 217 and the air exit member 220 includes an air exit passageway 227. The cross-sectional view along A, as shown in FIG. 5, and the cross-sectional view along B of FIG. 6, reveals that air may enter the air intake passageway 217, travel into the air intake member 210, pass through the threaded male extension 211 into the air exit member 220 and exit through the air exit passageway 227. As shown in FIG. 8, the air is free to pass through the threaded male extension 211 into the air exit member 220 via a space 205 surrounding the water supply tube 230 which has a smaller diameter than the hollow portions of the air intake member 210 and air exit member 220.

In practice, the assembled air intake member and air exit member unit 200 is installed proximate a bottom of a toilet tank near the water supply. Installation involves: (i) emptying a subject toilet tank; (ii) inserting threaded extension 211 through a conventional water supply opening in a bottom of the toilet tank; (iii) attaching the air exit member 220 to the air intake member 210 via the threaded extension 211; (iv) attaching a water supply tube 233 to the air exit member 220 via extension coupler 250 as shown in FIG. 7; and (v) attaching a float mechanism 265 to the air intake member 210 via float mechanism coupling 255 as shown in FIG. 7. Once the air intake member and air exit member unit 200 is installed, an air exit tube 275 containing fan member 280 is attached to air exit member 220. In this manner, the fan member 280, when activated and below a water level during a flush operation, draws or sucks air through the air intake member 210 within the toilet tank and from the toilet bowl via the opening between the toilet tank and toilet bowl or via the water overflow tube. An air intake tube may be attached to the air intake member 210 at one end and extend to the toilet bowl through a flapper blocking the opening between the toilet tank and toilet bowl or directly from the toilet tank to the toilet bowl via sealed openings. The second end of the air intake tube may extend into the toilet bowl rim or elsewhere within the toilet bowl above water level.

Figure 9:
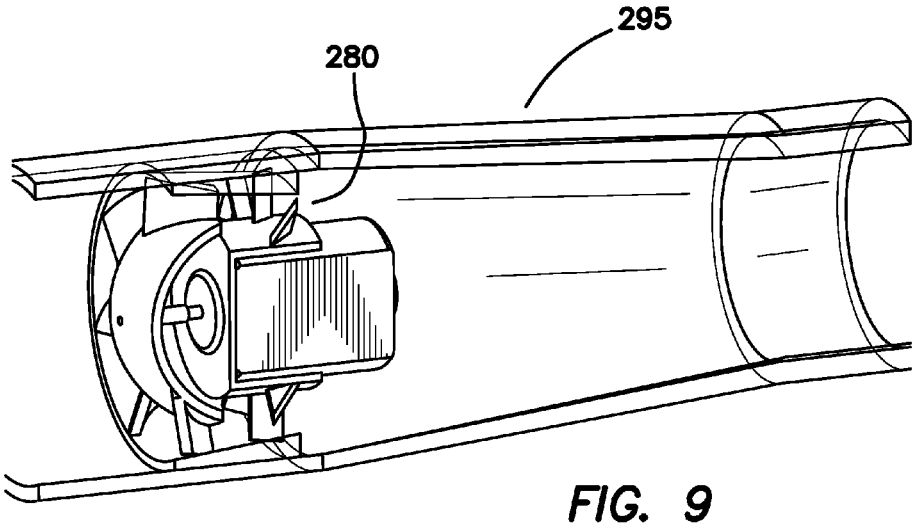
FIG. 9 illustrates a cross-sectional view of a fan housing according to the embodiments of the present invention.
Figure 10:
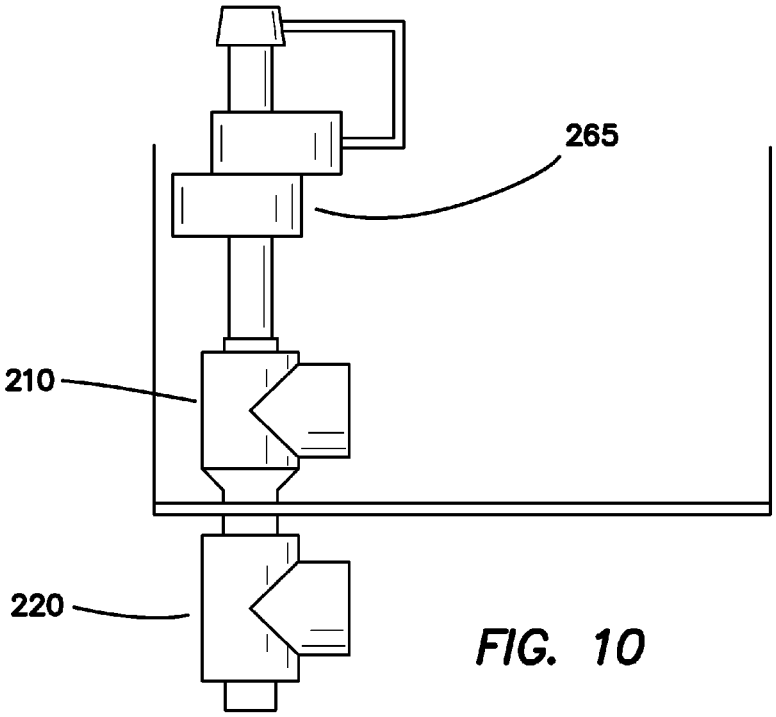
FIG. 10 illustrates a front view of the air intake assembly and air exit member unit attached to a conventional toilet according to the embodiments of the present invention.

FIG. 9 shows a fan housing 295 which contains the fan member 280. The fan housing 295 may be incorporated into the air exit tube 275, connected directly to the air intake member 210 or form part of the air exit tube 275. FIG. 10 shows the air intake member and air exit member unit 200 installed proximate to a bottom of a toilet tank 300 near the water supply 310 as described above. Activating the fan member 280 may be automated or manual. In an automated embodiment, pushing down the handle to trigger the flush operation may activate the fan member 280 for a pre-established time period. Other actions may cause the fan member 280 to activate. In a manual embodiment, the user may activate the fan member 280 using a switch or button proximate the toilet. In another embodiment, a remote control unit may be configured to activate the fan member 280.

Figure 11:
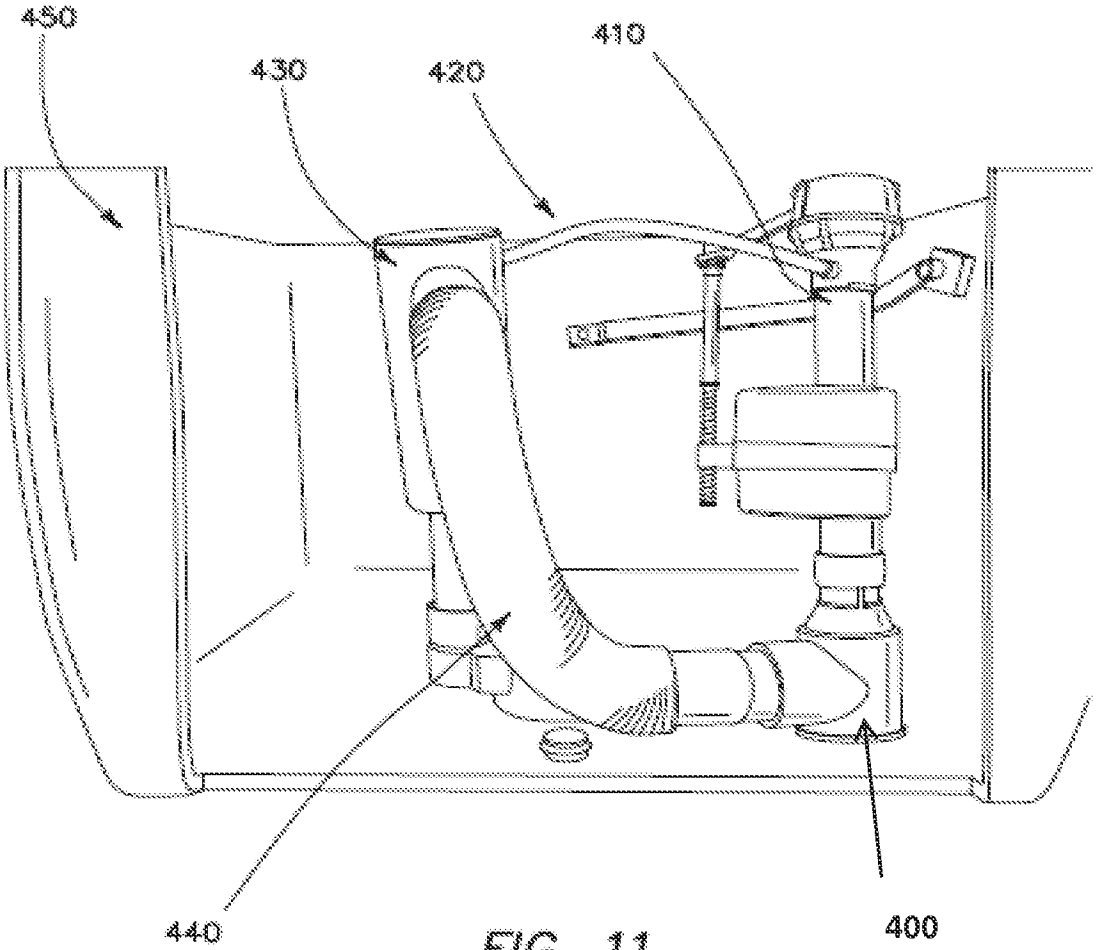
FIG. 11 illustrates an internal view of a toilet tank with a system installed according to the embodiments of the present invention.

FIG. 11 shows the internal portion of a toilet tank 450 with a toilet air evacuation system installed according to the embodiments of the present invention. Air intake member 400 receives a float and water fill mechanism 410. A water fill tube 420 extends from said float and water fill mechanism 410 to a water overflow tube 430. An air evacuation tube 440 extends from said water overflow tube 430 to said air intake member 400. The water overflow tube 430 leads to the toilet bowl. Accordingly, as the flushing process occurs, a motorized fan (not shown in FIG. 11) draws air through an air exit member (not shown in FIG. 11) outside of said toilet tank, said air intake member 400 within said toilet tank and in communication with said air exit member, said air evacuation tube 440, water overflow tube 430 and toilet bowl. That is, the fan draws air from the toilet bowl and causes it to travel through said water overflow tube 430, air evacuation tube 440, air intake member 400, air exit member and through an air exit tube (not shown in FIG. 11).

Although the invention has been described in detail with reference to several embodiments, additional variations and modifications exist within the scope and spirit of the invention as described and defined in the following claims.

I claim:

1. A toilet odor removal system comprising:

an air intake member within a toilet tank, said air intake member communicatively joined, via an air evacuation tube, to a water overflow tube, said water overflow tube having an open top end unimpeded by said air evacuation tube, said air evacuation tube connected directly to said water overflow tube through an outer, side surface thereof creating a passageway from said side surface of said overflow tube directly to said air evacuation tube such that gases are pulled from said overflow tube into said air evacuation tube prior to escaping through said open top end of said overflow tube;

an air exit member removably attachable to said air intake member, said air exit member substantially external to said toilet tank;

a water supply tube configured to extend through said air intake member and said air exit member;

a float mechanism coupling configured to attach at one end to said air intake member and a second end to a float mechanism; and a fan member configured to draw air from a toilet bowl through said water overflow tube then said tube member then said air intake member and then said air exit member.

2. The toilet odor removal system of claim 1 further comprising an extension coupler configured to attach at one end to said air exit member and a second end to a water supply.

3. The toilet odor removal system of claim 2 wherein said extension coupler is attachable to said water supply tube via an intermediary member.

4. The toilet odor removal system of claim 1 wherein said water supply tube is configured to attach to said float mechanism coupling.

5. A combination comprising:

a toilet comprising:

a tank, bowl, flapper, water overflow tube and float mechanism, said tank having an opening leading to the bowl, said opening removably sealed by said flapper; and an odor removal device comprising:

an air intake member having an extension coupler extending through a water supply opening in said tank, said air intake member communicatively joined, via an air evacuation tube, to said water overflow tube, said water overflow tube having an open top end unimpeded by said air evacuation tube, said air evacuation tube connected directly to said water overflow tube through an outer, side surface thereof creating a passageway from said side surface of said overflow tube directly to said air evacuation tube such that gases are pulled from said overflow tube into said air evacuation tube prior to escaping through said open top end of said overflow tube;

an air exit member removably attached to said air intake member via said extension coupler extending through said opening in said tank;

a water supply tube extending through said air intake member and said air exit member;

a float mechanism coupling attached at one end to said air intake member and a second end to said float mechanism; and a fan member configured to draw air from said bowl via said water overflow tube then said tube member then said air intake member and then air exit member.

6. The toilet odor removal system of claim 5 further comprising an extension coupler configured to attach at one end to said air exit member and a second end to a water supply.

7. The toilet odor removal system of claim 6 wherein said extension coupler is attachable to said water supply tube via an intermediary member.

8. The toilet odor removal system of claim 5 wherein said water supply tube is configured to attach to said float mechanism coupling.

9. A method comprising:

activating a fan drawing air from a toilet bowl via (i) a water overflow tube internal to a toilet tank and in communication with said toilet bowl; (ii) air evacuation tube internal to said toilet tank and connected at a first end to an outer, side surface of said water overflow tube creating a passageway from said side surface of said overflow tube directly to said air evacuation tube such that gases are pulled from said overflow tube into said air evacuation tube prior to escaping through an open top end of said overflow tube; (iii) air intake member internal to said toilet tank and connected to a second end of said air evacuation tube; (iv) air exit member external to said toilet tank and in communication with said air intake member; and (v) air exit tube.

10. The method of claim 9 further comprising positioning said fan to communicate with said air exit tube.

11. The method of claim 9 further comprising extending a water supply tube through said air intake member.

12. The method of claim 9 further comprising extending a water supply tube through said air exit member.

* * * * *